US007568272B2

(12) United States Patent
Morita et al.

(10) Patent No.: US 7,568,272 B2
(45) Date of Patent: Aug. 4, 2009

(54) PRESS-FORMING METHOD, PRESS-FORMING MACHINE AND PRESS-FORMED PRODUCT

(75) Inventors: Tsukasa Morita, Ebina (JP); Noriaki Kawauchi, Ebina (JP); Toshihiro Seki, Oyama (JP); Akihiko Satou, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 453 days.

(21) Appl. No.: 10/988,702

(22) Filed: Nov. 16, 2004

(65) Prior Publication Data

US 2005/0115300 A1 Jun. 2, 2005

(30) Foreign Application Priority Data

Nov. 27, 2003 (JP) ..... 2003-397421
Mar. 29, 2004 (JP) ..... 2004-095367

(51) Int. Cl.
*B21D 31/00* (2006.01)

(52) U.S. Cl. ..... 29/430; 72/379.2

(58) Field of Classification Search ..... 72/363, 72/379.2, 379.6, 377, 395, 411; 29/428, 29/429, 430, 446, 505, 514
See application file for complete search history.

(56) References Cited

U.S. PATENT DOCUMENTS 3,156,034 A * 11/1964 Gruetjen ..... 29/897.2
3,499,308 A * 3/1970 Ford ..... 72/380
5,487,219 A * 1/1996 Ruehl et al. ..... 29/897
5,735,163 A * 4/1998 Sato et al. ..... 72/348

FOREIGN PATENT DOCUMENTS

| | | | |
|---|---|---|---|
| EP | 0 534 704 A1 | | 3/1993 |
| GB | 883022 | | 11/1961 |
| JP | 6-218440 A | | 8/1994 |
| JP | 7-290182 A | | 11/1995 |
| JP | 10-180470 A | | 7/1998 |
| JP | 11-104750 A | | 4/1999 |
| JP | 2000-071022 | * | 3/2000 |
| JP | 2000-071022 A | | 3/2000 |
| JP | 2003-19516 A | | 1/2003 |

* cited by examiner

*Primary Examiner*—David P Bryant
*Assistant Examiner*—Christopher M Koehler
(74) *Attorney, Agent, or Firm*—Foley & Lardner LLP

(57) ABSTRACT

In a press-forming method, a plurality of plates are prepared and end faces of the plurality of plates are butt joined to obtain a blank having joined portions. The blank has deformed-shape sections formed in a vicinity of the joined portion so as to deform in a direction along which peripheral lengths of the deformed-shape sections are stretched. Press-forming, involving stretch-flange formation, is carried out on the blank so as to allow the joined portions to be included in stretching regions, respectively. Also, the stretch-flange formation is carried out on the blank while restraining ends of the joined portion of the blank.

13 Claims, 10 Drawing Sheets

PRESS-FORMING METHOD, PRESS-FORMING MACHINE AND PRESS-FORMED PRODUCT

BACKGROUND OF THE INVENTION

The present invention relates to a press-forming method, a press-forming machine and a press-formed product and more particularly, to a press-forming method, a press-forming machine and a press-formed product using a blank formed of different kinds of plates whose end faces are butt joined.

Japanese Patent Application Laid-Open Publication Nos. 10-180470, 11-104750 and 2003-19516 disclose the use of a blank, as a press material, which is formed of different kinds of plates whose end faces are butt joined. The press material is able to select an optimum plate thickness and strength for each area, making it possible to achieve reduction in the number of component parts and light weight.

SUMMARY OF THE INVENTION

However, upon studies conducted by the present inventors, the different kinds of plates as the press material are obtained by blanking a plate of raw material and, in order to avoid the occurrence of burring, the plates are formed with corners formed in gently curved configurations and the presence of plates joined by welding provides a tendency with the joined portion being hardened.

That is, due to the presence of a V-shaped configuration in the joined portion between the different kinds of plates and a drop in a stretching ductility of the joined portion, it is conceivable that if the joined portion is located in a stretching region, to which stretch-flange formation is carried out, conducting press-forming, involving stretch-flange formation, causes stress concentration to occur in the joined portion between the different kinds of plates to cause cracks or breakings to occur. This results in causes for deterioration in yield of materials and an increase in costs.

The present invention has been completed with the above study in mind and has an object to provide a press-forming method and a press-forming machine, which are able to minimize the occurrence of cracks and breakings in a joined portion located in stretching regions, to which stretch-flange formation is carried out, in a blank formed of different kinds of plates whose end faces are butt joined, and a press-formed product that has a less number of component parts and is low in cost.

To achieve the above object, a method of press forming, according to one aspect of the present invention, comprises: preparing a plurality of plates; obtaining a blank with joined portions of the plurality of plates whose end faces are butt joined, the blank having deformed-shape sections formed in a vicinity of the joined portion so as to deform in a direction along which peripheral lengths of the deformed-shape sections are stretched; and carrying out press-forming, involving stretch-flange formation, on the blank so as to allow the joined portions to be included in stretching regions, respectively.

Further, a press-forming machine, according to another aspect of the present invention, comprises: a forming mechanism carrying out press-forming, involving stretch-flange formation, a blank having a joined portion obtained by butt joining end faces of a plurality of plates; and a restraining mechanism restraining ends of the plurality of plates during the press-forming with the forming mechanism.

Furthermore, according to another aspect of the present invention, a press-formed product comprises: a thick plate; a thin plate, the thick plate and the thin plate being joined at joined portions and formed by press-forming involving stretch-flange formation; and bent portions formed in at least one of the thick plate and the thin plate, stretching regions, to which the stretch-flange formation is carried out, including the bent portions and the joined portions.

Other and further features, advantages, and benefits of the present invention will become more apparent from the following description taken in conjunction with the following drawings.

DETAILED DESCRIPTION OF THE PREFERRED EMBODIMENT

Hereinafter, a press-forming method, a press-forming machine and a press-formed product of an embodiment according to the present invention are described with suitable reference to FIGS. 1 to 16 of the accompanying drawings.

Incidentally, throughout drawings, x-, y- and z-axes form a rectangular coordinate system.

Figure 1:
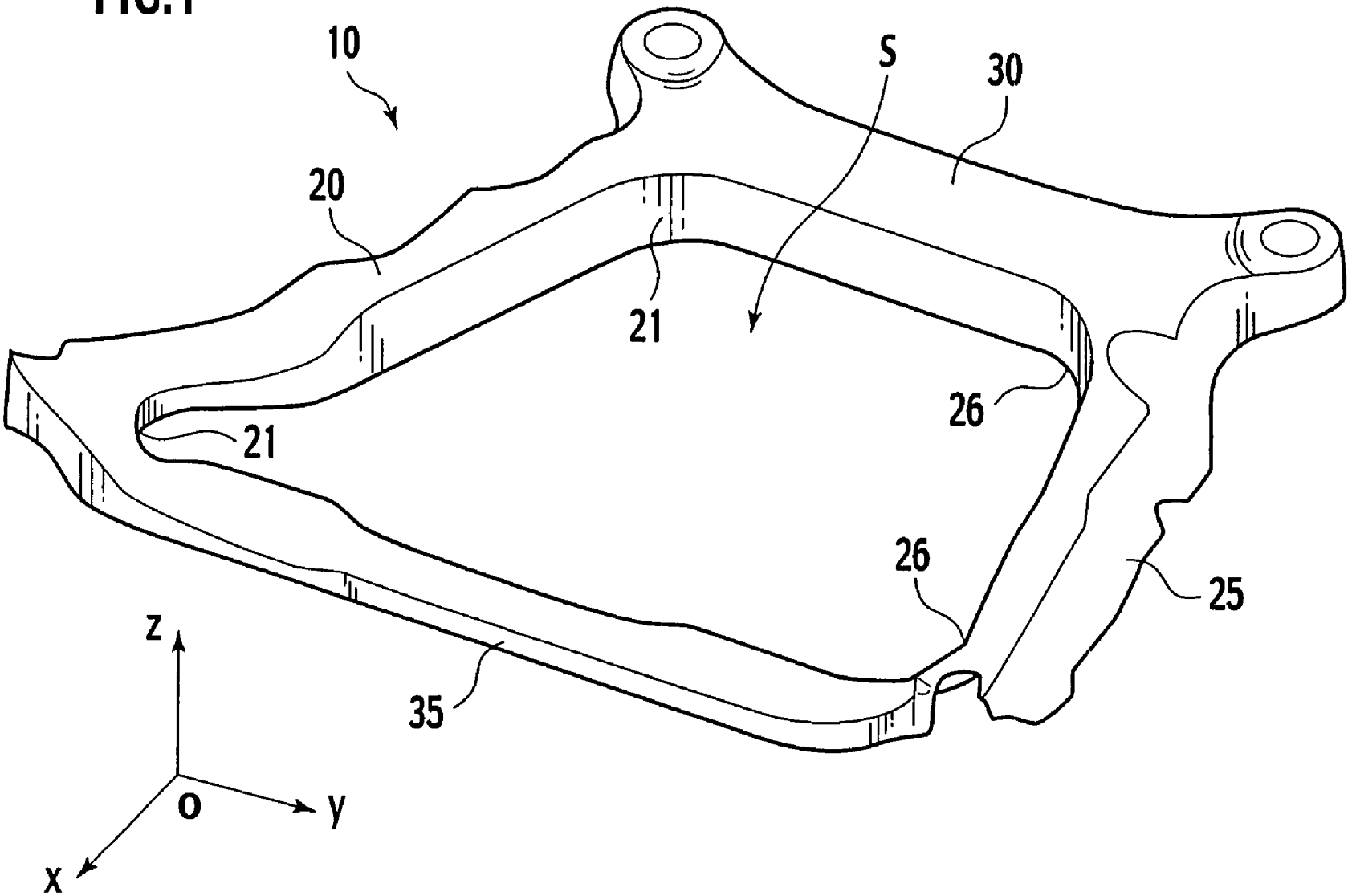
FIG. 1 is a schematic perspective view of a press-formed product of an embodiment according to the present invention.

FIG. 1 is a schematic perspective view illustrating a press-formed product of an embodiment according to the present invention.

As shown in FIG. 1, the press-formed product of the presently filed embodiment is a suspension member 10, of an automobile for use in connecting an axle component and a vehicle, which is formed of aluminum alloy or steel.

The suspension component 10 is comprised of side members 20, 25 and cross members 30, 35. The side members 20, 25 have respective ends whose inner peripheries have bent portions 21, 26, and end faces of the bent portions 21, 26 are connected to end faces of the cross members 30, 35. Accordingly, the suspension component 10 takes the form of a loop configuration with an inside formed with a space (opening) S and, as viewed in the z-axis direction, has a closed configuration.

Figure 2:
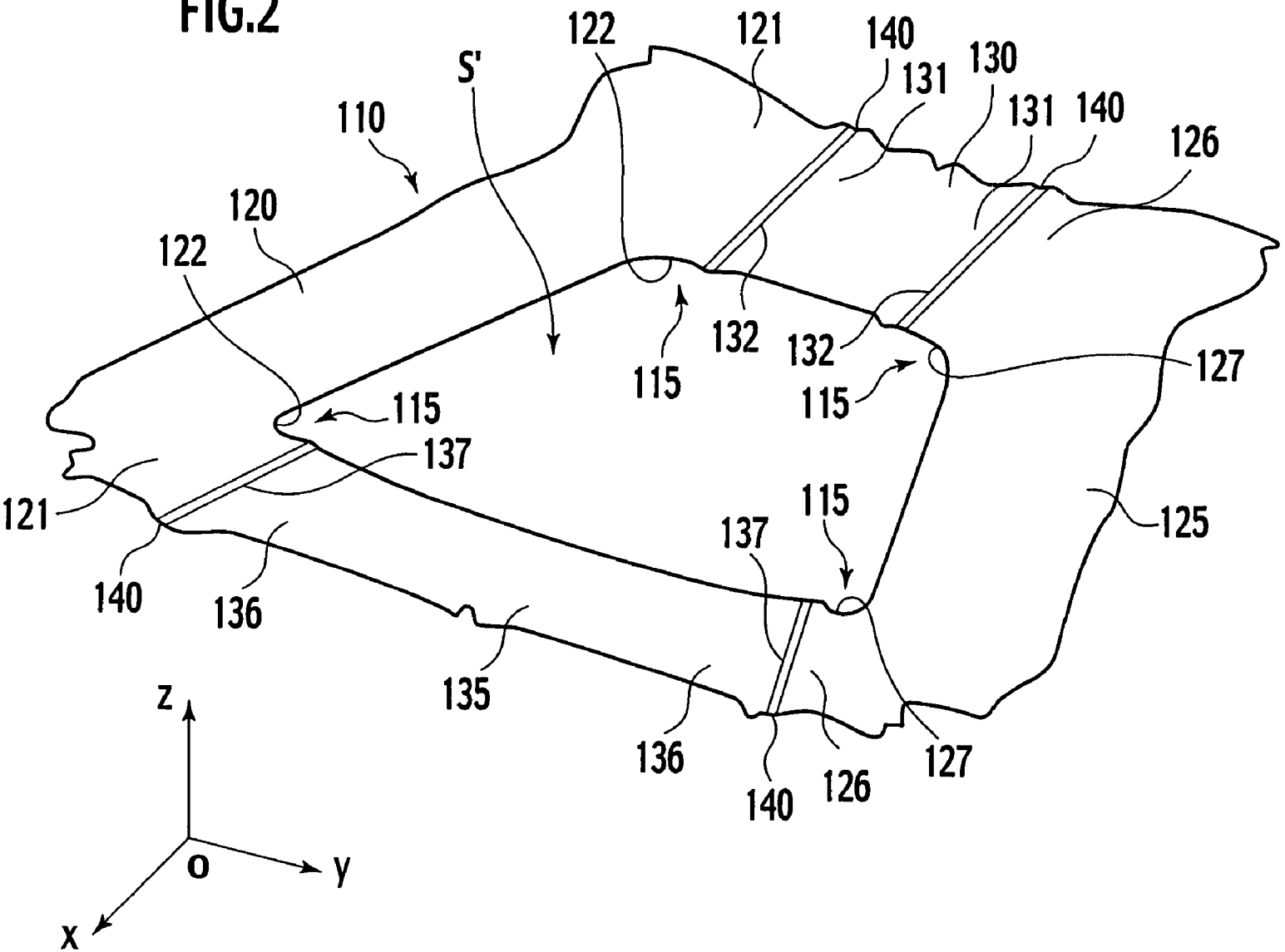
FIG. 2 is a schematic perspective view of a press material of the presently filed embodiment.

FIG. 2 is a schematic perspective view illustrating a press material of the presently filed embodiment.

As shown in FIG. 2, a press material of the presently filed embodiment is composed of a tailored blank (tailor welded blank) 110, formed of different kinds of plates whose end faces are butt joined, and subjected to press forming (final press-forming) involving stretch-flange formation to form the suspension component 10. Incidentally, reference numeral 115 designates stretching regions to which stretch-flange formation is carried out during final press forming.

For various parts of the tailored blank 110, an optimum thickness or material and strength may be selected for each part, thereby enabling reduction in the number of component parts and lightweight. Examples of joining methods may preferably include a plasma welding suited for carrying out the press formation after welding but may be possible to apply laser welding or electron beam welding.

The tailored blank 110 of the presently filed embodiment is a different-thickness tailored blank involving thick plate sections 120, 125 formed of a plate with an increased thickness, thin plate sections 130, 135 formed of a plate with a reduced thickness, and joined portions 140 through which the thick plate sections 120, 125 and the thin plate sections 130, 135 are connected and, as viewed in the z-axis direction, takes the form of a closed configuration with an inside formed with a space S'.

The thick plate sections 120, 125 and the thin plate sections 130, 135 constitute the side members 20, 25 and the cross members 30, 35, respectively, after the final press-forming is carried out. Inner peripheries of distal ends 121, 126 of the thick plate sections 120, 125 have bent portions 122, 127, respectively.

The stretching regions 115, which are subjected to the stretch-flange formation in the final press-forming, include the bent portions 122, 127, the joined portions 140 and proximities (involving proximities of the end faces 132, 137 of the distal ends 131, 136 of the thin plate sections 130, 135) of the joined portions 140. That is, the joined portions 140 are located in the stretching regions 115 that is subjected to the stretch-flange formation.

The bent portions 122, 127 constitute the bent portions 21, 26 of the side members 20, 25, respectively, after the final press-forming.

Now, description is made of a method of forming the tailored blank.

Figure 3A:
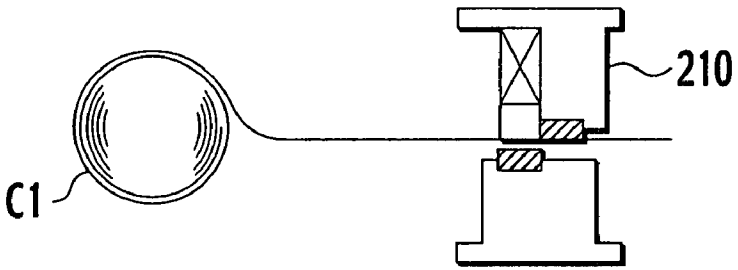
FIG. 3A is a schematic view illustrating a condition in which a coil is fed to a blanking machine to form component parts of the press material of the presently filed embodiment.
Figure 3B:
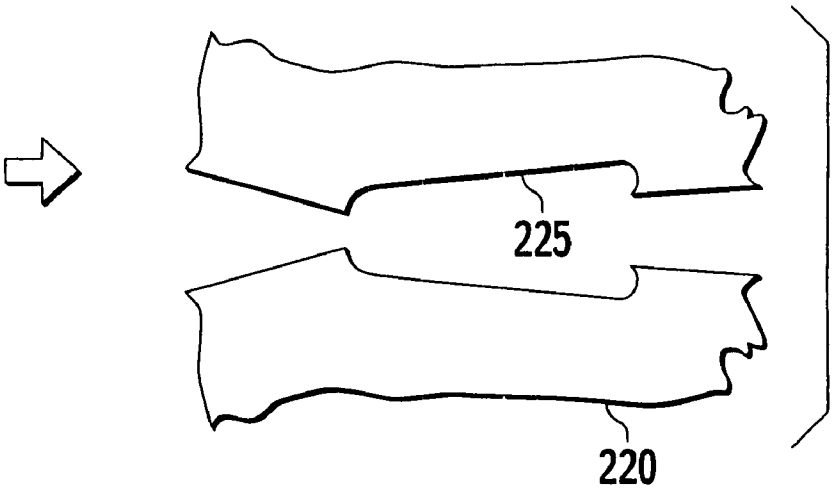
FIG. 3B is a schematic plan view showing the component parts of the press material obtained by blanking with the blanking machine of the presently filed embodiment.
Figure 3C:
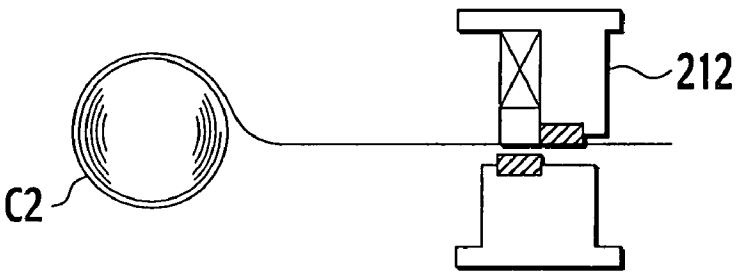
FIG. 3C is a schematic view illustrating a condition in which the coil is fed to the blanking machine to form another component parts of the press material of the presently filed embodiment.
Figure 3D:
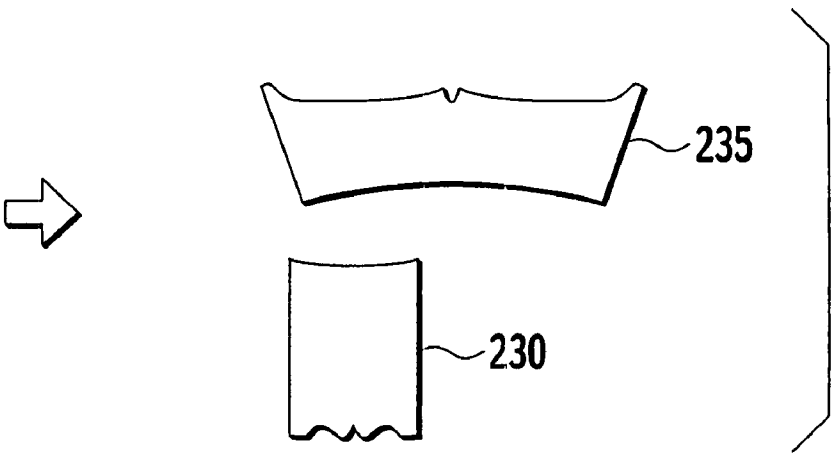
FIG. 3D is a schematic plan view showing another component parts of the press material obtained by blanking with the blanking machine of the presently filed embodiment.
Figure 4A:
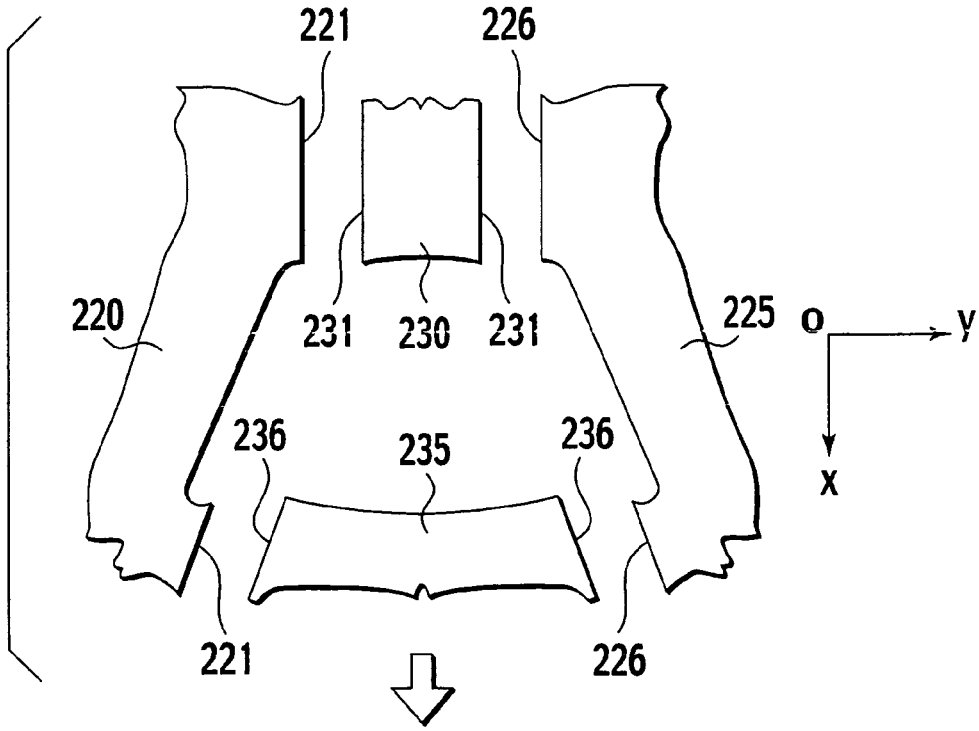
FIG. 4A is a schematic plan view illustrating the various component parts of the press material of the presently filed embodiment under a condition prior to positioning thereof.
Figure 4B:
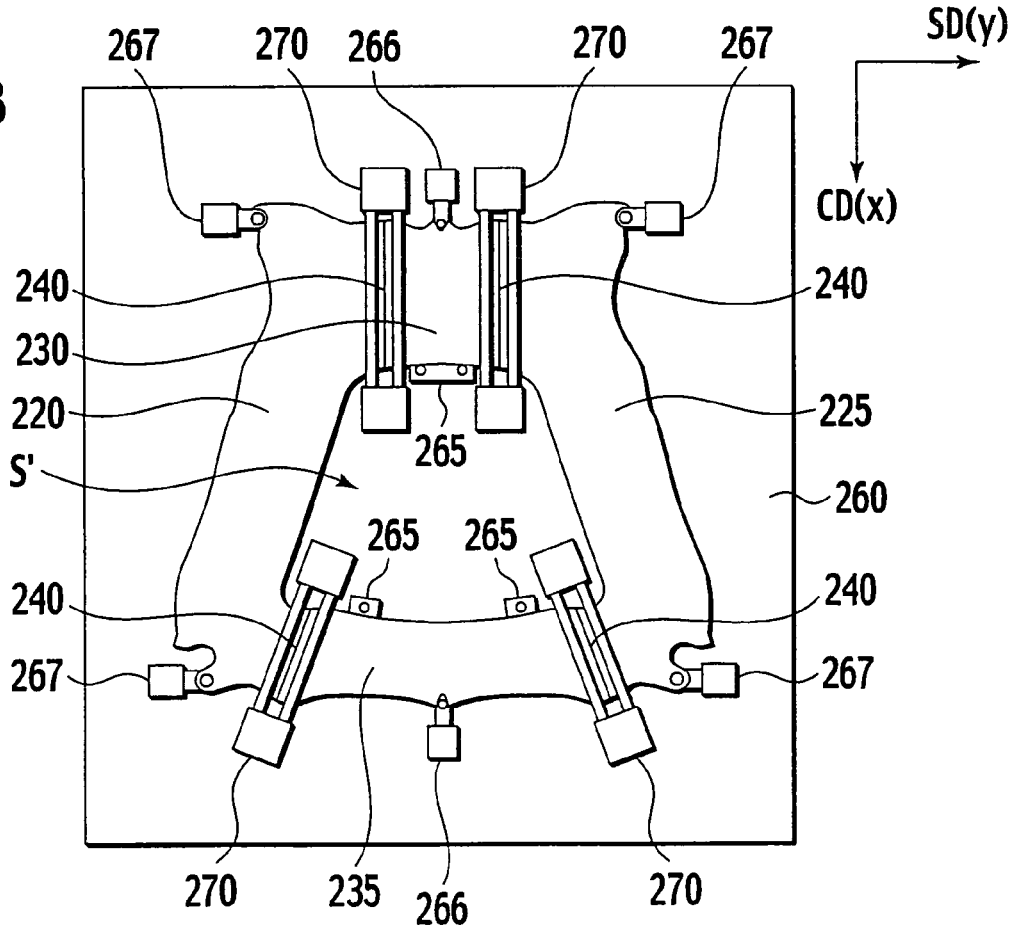
FIG. 4B is a schematic plan view illustrating the various component parts, under a condition where they are positioned and fixed in place, of the press material of the presently filed embodiment.
Figure 5:
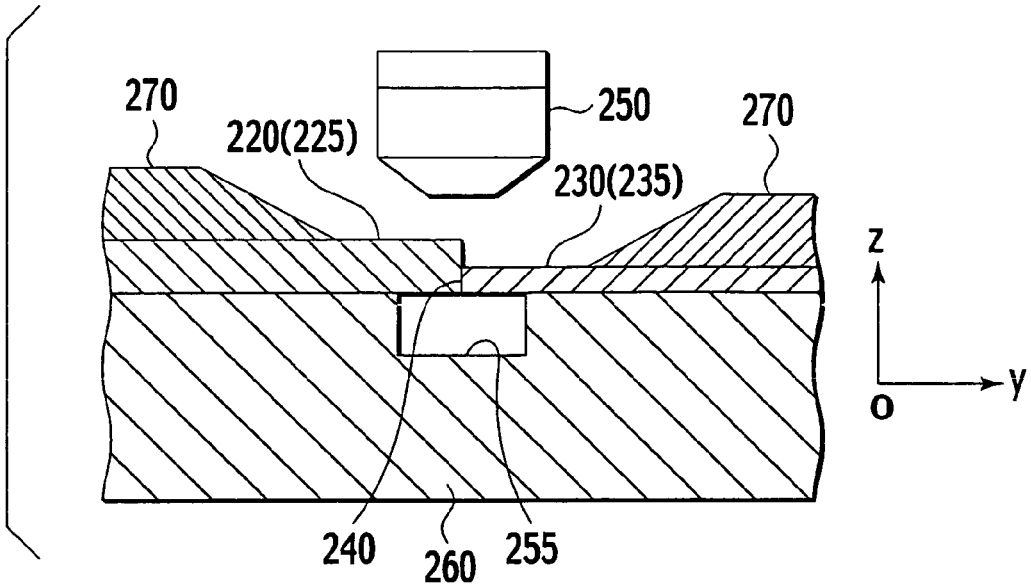
FIG. 5 is a schematic cross sectional view illustrating proximities of a joined portion of the various component parts of the press material of the presently filed embodiment under a condition where the proximities are joined during joining operation thereof.

FIG. 3A is a schematic view illustrating a status in which a sheet coil is fed to a blanking machine that performs blanking to form component elements of press material, i.e., the component elements of the tailored blank; FIG. 3B is a schematic plan view illustrating the component elements of the tailored blank obtained by blanking with the blanking machine of the presently filed embodiment; FIG. 3C is a schematic view illustrating a status in which a sheet coil is fed to a blanking machine that performs blanking to form the other component elements of the press material of the presently filed embodiment; FIG. 3D is a schematic plan view illustrating the other component elements of the press material obtained by blanking with the blanking machine of the presently filed embodiment; FIG. 4A is a schematic plan view illustrating various component elements of the press material of the presently filed embodiment under a condition prior to the positioning of the component elements; FIG. 4B is a schematic plan view illustrating the various component elements of the press material of the presently filed embodiment under a condition where the various component elements are positioned and fixed in place; and FIG. 5 is a schematic cross sectional view illustrating a condition in which the proximities of the joined portion are joined during the joining operation for the various component elements of the press material of the presently filed embodiment.

As shown in FIGS. 3A to 3D, the plates 220, 225 formed of the thick plate sections 120, 125 and the plates 230, 235 formed of the thin plate sections 130, 135 are formed by blanking sheet coils C1, C2, different in thickness, with the blanking machines 210, 212, respectively.

As shown in FIGS. 4A and 4B, the plates 220, 225, 230, 235 resulting from the sheet coils C1, C2 are set (placed) on a jig base 260. With the various component parts positioned in respect of a cross direction CD (along the x-axis direction) and a side direction SD (along the y-axis direction) using positioning pins 265 to 267, the end faces 221, 226, 231, 236 are brought into abutment to form the loop configuration with the inside formed with the space S'. Here, by the term "cross direction CD" is meant the direction in which the plates 230, 235, which form the cross members 30, 35, respectively, are positioned and by the term "side direction SD" is meant the direction in which the plates 220, 225, which form the side members 20, 25, respectively, are positioned.

In performing the positioning related to the cross direction CD, the movable type positioning pins 266 are driven (moved) to allow the plates 230, 235 to be brought into abutment with stationary type positioning pins 265. In performing the positioning related to the side direction SD, the movable type positioning pins 267 are driven to allow the plates 220, 225 to be brought into abutment with the plates 230, 235 positioned by the stationary type positioning pins 265, 266.

The plates 220, 225, 230, 235, which are thus positioned, are fixedly secured by clamp mechanisms 270. The clamp mechanisms 270 are located along abutment surfaces 240 of the end faces 221, 226, 231, 236, respectively, and pressing the proximities of the respective abutment surfaces 240 allows the abutment surfaces 240 to be fixedly secured by depressing the abutment surfaces 240 to the jig base 260. Incidentally, when positioning the plates 220, 225, 230, 235, it may be preferable for the end faces 221, 226, 231, 236 to be pre-clamped to restrict their movable ranges for thereby minimizing defective abutments.

With the presently filed embodiment, a plasma spraying method of a plasma arc type may be applied to achieve the joining of the abutment surfaces 240. The plasma spraying method may be preferable because of an increased directivity and an increased weld penetration depth suited for carrying out the press formation after welding. However, it may be possible to apply other joining methods involving sprayings such as laser welding and electron beam welding.

As shown in FIG. 5, a plasma-welding machine includes a torch 250 for ejecting plasma arc. The torch 250 has a plasma gas passage, a sealing gas passage for a weld portion and an electrode (cathode), any of which is shown. Plasma gas may include argon and sealing gas may include mixed gas between argon and hydrogen.

The jig base 260, which is held in contact with the plates 220, 225, 230 and 235 fixedly secured in place with the clamp mechanisms 270, functions as an electrode (anode) that is held in face-to-face relationship with the electrode of the torch 250. Accordingly, the torch 250 is operative to eject plasma arc toward the abutment surfaces 240 among the plates (materials to be welded).

The jig base 260 has recesses 255 formed in areas corresponding to the abutment surfaces 240. The recesses 255 are used for precluding areas, exposed to high temperatures caused by the plasma arc, and weld beads from being depositing onto the jig base 260 while admitting the flow of sealing gas for the weld portions. Consequently, with the torch 250 placed in a position above one end (starting point) of the abutment surface 240, moving the torch 250 toward the other end (terminal point) of the abutment surface 240 while causing the torch 250 to eject the plasma arc toward the abutment surface 240 enables the abutment surface 240 to be welded throughout the length thereof.

Carrying out such welding on the abutment surfaces 240 in four areas forms the tailored blank 110. Accordingly, the plates 220, 225, the plates 230, 235 and the abutment surfaces 240 form the thick plate portions 120, 125, the thin plate portions 130, 135 and the joined surfaces 140, respectively.

Figure 6:
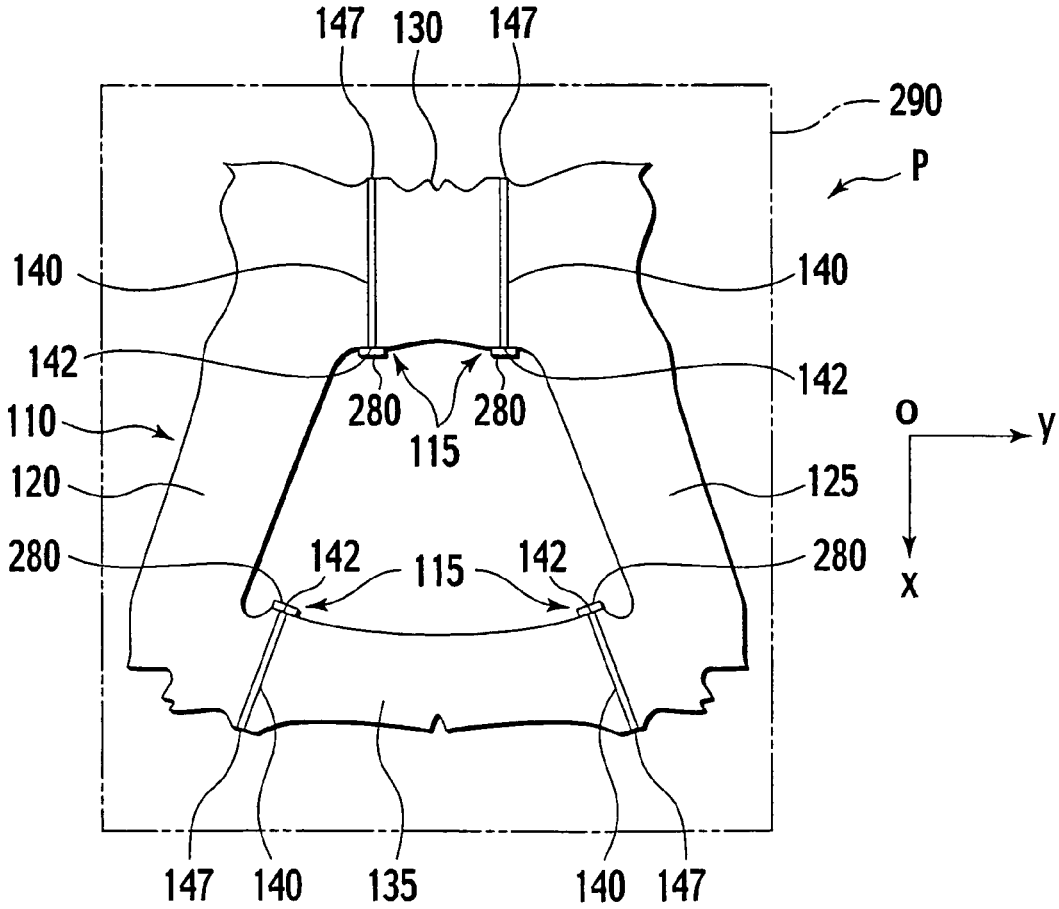
FIG. 6 is a schematic plan view illustrating the various component parts of the press material under a restrained condition with a restraining mechanism of a press-forming machine of the presently filed embodiment.
Figure 7:
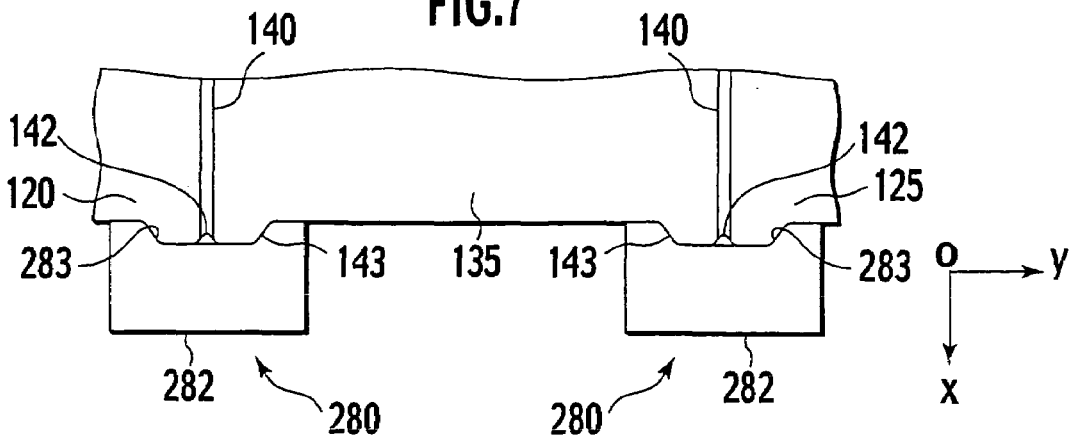
FIG. 7 is an enlarged detail plan view of FIG. 6.
Figure 8:
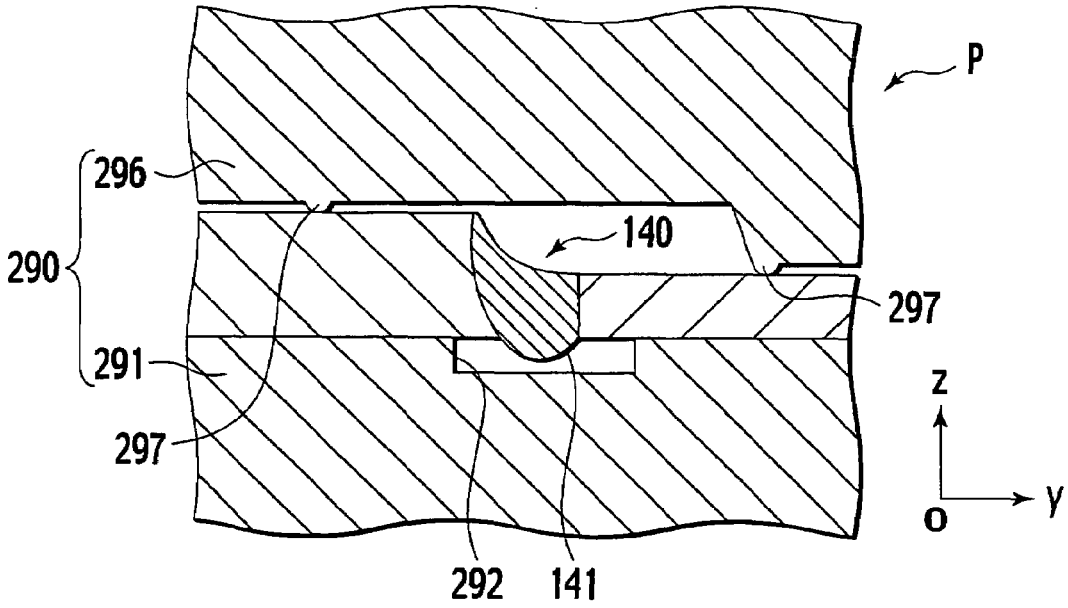
FIG. 8 is a schematic cross sectional view illustrating the press material under a condition where it is in press-forming by a forming mechanism of the press-forming machine of the presently filed embodiment.
Figure 9:
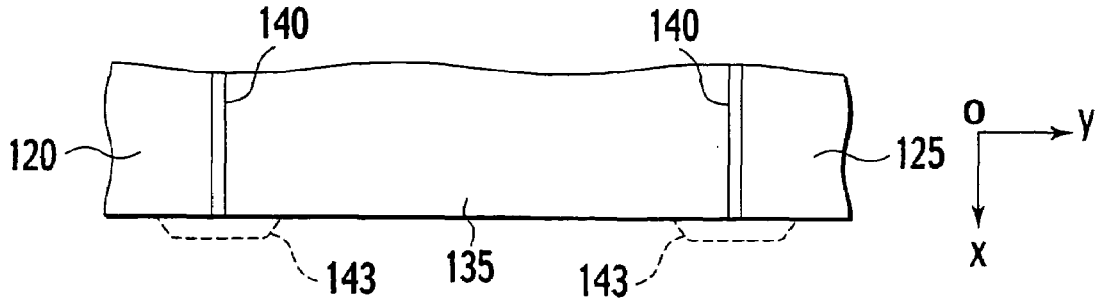
FIG. 9 is an enlarged detail plan view for illustrating a condition in which stepped portions are removed from the press material of the presently filed embodiment.

FIG. 6 is a schematic plan view illustrating the tailored blank 110 under a restrained condition through the use of restraining mechanisms of the press-forming machine P of the presently filed embodiment; FIG. 7 is an enlarged detail plan view of FIG. 6; FIG. 8 is a schematic cross sectional view illustrating a status in which the press formation is carried out with a forming mechanism of the press forming machine of the presently filed embodiment; and FIG. 9 is an enlarged detail plan view illustrating how the stepped portions of the press material of the presently filed embodiment are removed.

As shown in FIGS. 6 to 8, the press-forming machine P includes a restraining mechanisms 280 for restraining the joined end faces 142 of the tailored blank 110, and a forming mechanism 290 for press-forming the tailored blank 110.

The joined end faces 142 are located in the stretching regions 115, respectively, to which the stretch-flange formation is carried out at an inward of the tailored blank 110 and subjected to concentrated stress occurring when press-forming with the forming mechanism 290. However, with the joined end faces 142 restrained with the restraining mechanism 280, the occurrence of cracks or breakings can be eliminated. Also, depending upon needs, the joined end faces 147, located at an outer periphery of the tailored blank 110, may be similarly restrained.

Formed on the respective joined end faces 142 are stepped portions 143, whose end faces protrude in a direction extending from the joined end faces 142, which are restrained by the restraining mechanisms 280. In particular, the restraining mechanisms 280 have nests (male-type segments) 282 corresponding to the stepped portions 143, respectively. The nests 282 are located to be moveable in a closing or separating capability with respect to the joined end faces 142 to allow openings 283 of the nests 282 to reliably restrain the stepped portions 143, respectively.

In view of productivity, the stepped portions 143 may be preferably formed during a stage when blanking the sheet coil in a process shown in FIGS. 3A to 3D. In this case, the stepped portions 143 may be possibly utilized for positioning the blanked plates 220, 225, 230, 235 on the jig base 260 for welding in a process shown in FIGS. 4A and 4B.

The forming mechanism 290 is comprised of a first forming die 291 having a concave portion 292 and a second forming die 296 located in face-to-face relationship with the first forming die 291. The concave portion 292 is formed in the second forming die 291 in a position in a face-to-face relationship with a weld bead 141 formed in the joined portion 140 of the tailored blank 110. The concave portion 292 is scaled to be formed in a larger configuration than that of the weld bead, i.e., formed to provide a die clearance, such that the concave portion 292 has a depth slightly greater than the thickness of the plates to be welded.

Accordingly, the concave portion 292 is able to hold the weld bead 141 in non-abutment condition during press-forming, thereby preventing the weld bead 141 from being pressed toward the first forming die 291 to cause cracking.

The second forming die 292 has a pair of projections 297 to be placed in face-to-face relationship with proximities of the concave portion 292. The projections 297 press the proximities of the weld bead 141 against the proximities of the concave portion 292 of the first forming die 291, enabling to eliminate the flow of material of the tailored blank 110.

Consequently, during press-forming, the occurrence of undesired cockling can be minimized.

Of course, so-called cavity surfaces of the weld bead 141 and its adjacent proximities may be preferably set in a scale to lie in a large radius of curvature with less amount of protrusion. This is because the occurrence of minute (fine) cracks in the weld bead 141 and the occurrence of deteriorated appearances with roughened surfaces are eliminated.

Additionally, the joined end faces 142 are located at respective starting points or terminal points of welding to cause the joined end faces 142 and the adjacent proximities to form areas that are apt to suffer from welding defects such as perforating or sputtering with a resultant unstable welding quality, and the stepped portions 143 involve such joined end faces 142 and the adjacent proximities.

With the above view in mind, as shown in FIG. 9, removing the stepped portions 143 after press-forming enables an improvement over welding quality. Incidentally, the other joined end faces 147 may be formed with stepped portions, which will be removed after press-forming, thereby enabling further improvement over welding quality.

As set forth above, with the press-forming machine of the presently filed embodiment, the press formation can be realized to form the blank whose joined end faces are formed of different kinds of plates that are butt joined with minimized occurrence of cracks or breakings.

Incidentally, the stepped portions 143 to be formed and the nests 282 to be located may be appropriately minimized or omitted. For example, utilizing projections or indents formed in the vicinity of the joined end faces 142 enables the joined end faces 142 to be restrained.

Now, further detailed description is made of a press-forming method using the press-forming machine with the structure mentioned above.

First, the tailored blank 110 is set on the first forming die 291. In such setting, the tailored blank 10 is positioned such that the weld bead 141 formed in the joined portion 140 of the tailored blank 110 is fitted in the concave portion 292 of the first forming die 291.

Then, the restraining mechanisms 280 are driven such that the nests 282 are moved closer to the tailored blank 110 to cause the stepped portions 143 of the tailored blank 110 to be restrained with the opening portions 283 of the respective nests 282. This causes the joined end faces 142, located at substantially centers of the respective stepped portions 143, to be fixedly secured (restrained).

Next, the second forming die 296 is driven to move closer to the first forming die 291 in face-to-face relationship therewith to allow press-forming the tailored blank 110 stacked on the first forming die 291. When this takes place, the projections 297 of the first forming die 296 press the proximities of the respective weld beads 141 against the proximities of the respective concave portions 292 of the first forming die 291 to avoid the flow of material of the tailored blank 110.

Here, although stress concentrates on the joined end faces 142 of the tailored blank 110, the stepped portions 143 involving the joined end faces 142 and the adjacent proximities are restrained with the nests 282 of the restraining mechanisms 280 and the occurrence of cracks and breakings can be eliminated.

Further, since the concave portion 292 of the first forming die 291 allows the weld bead 141 of the tailored blank 110 to be maintained in non-abutting engagement, the weld bead 141 is not pressed in the first forming die 291, thereby precluding the occurrence of cracks.

Subsequently, the stepped portions 143 are removed from a press-formed product. Since the stepped portions 143 involve areas (the joined surfaces and the adjacent proximities), where a welding quality is unstable, the press-formed product with the stepped portions 143 being removed results in a favorable welding quality.

As set forth above, first, with the press-forming method of the presently filed embodiment, the press formation can be realized with minimized occurrence of cracks or breakings in the joined surfaces of the tailored blank formed by butt joining end faces of different kinds of plates.

By the way, the tailored blank 110 of the presently filed embodiment is formed with deformed-shape sections 150, which will be described hereinafter in detail.

Figure 10:
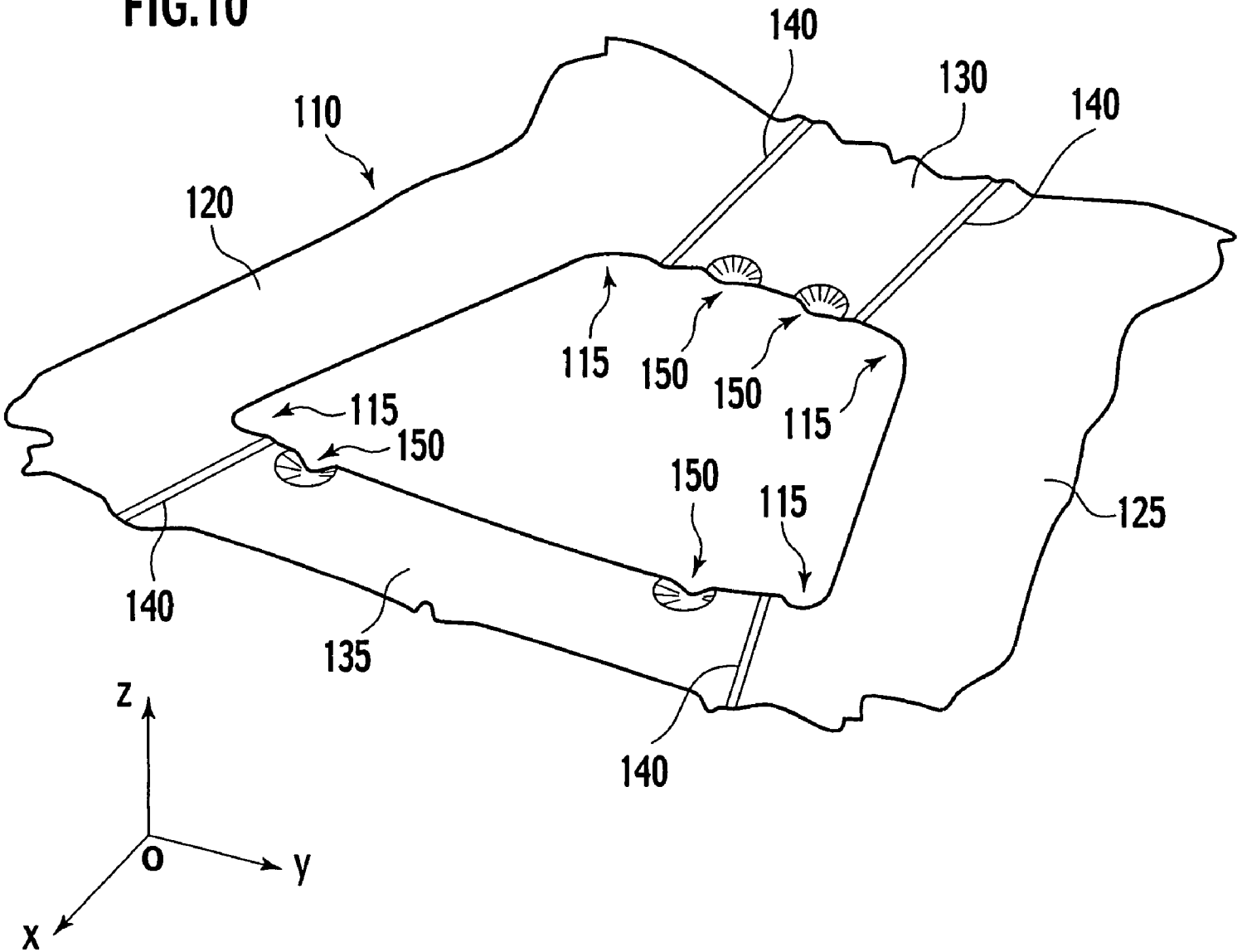
FIG. 10 is a schematic perspective view illustrating deformed-shape sections provided in the press material of the presently filed embodiment.
Figure 11:
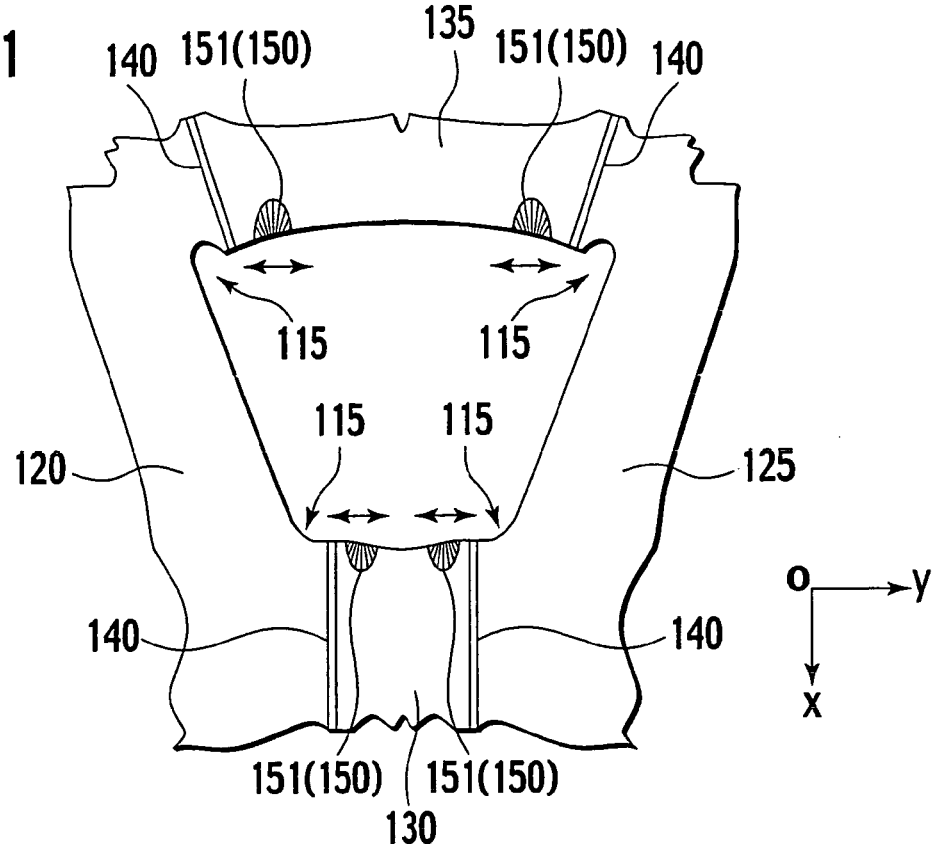
FIG. 11 is a schematic plan view illustrating shapes and layouts of the deformed-shape sections provided in the press material of the presently filed embodiment.
Figure 12:
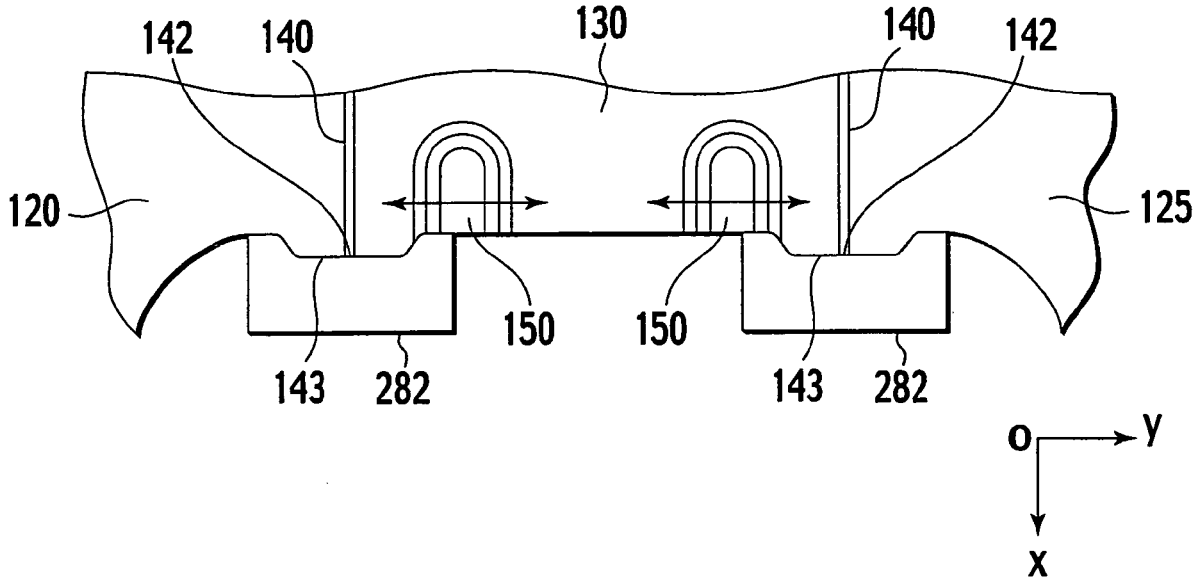
FIG. 12 is an enlarged detail plan view illustrating the deformed-shape sections of the press material in the presently filed embodiment under a situation where the deformed-shape sections are stretched under restrained condition.

FIG. 10 is a schematic perspective view illustrating deformed-shape sections in the press material of the presently filed embodiment; FIG. 11 is a schematic plan view illustrating shapes and layouts of the deformed-shape sections in the press material of the presently filed embodiment; and FIG. 12 is an enlarged detail plan view illustrating a status wherein the deformed-shape sections of the press material of the presently filed embodiment are restrained and expanded (stretched). Incidentally, in drawings, both arrows each substantially along the y-axis direction conceptually designate how peripheral lengths of the deformed-shape sections are expanded or stretched.

As shown in FIGS. 10 and 11, with the press-forming method of the presently filed embodiment, the tailored blank 110 is formed with the deformed-shape sections 150, at positions close proximity to the joined portions 140, respectively, which deform in a direction to allow their peripheral lengths to expand.

The deformed-shape sections 150 are formed in the thin plates 130, 135 in the vicinity of the joined portions 140, respectively, and in final press forming, deform to stretch their peripheral lengths for thereby easing up the stretching of the stretching regions 115 during stretch-flange formation.

Here, an outer periphery of the tailored blank 110 does not form a stretch-flange during final press-forming and tends to cause the formation of creases rather than underfills and, so, less need arises for forming the deformed-shape sections 150 that deform in a direction in which the peripheral length extends. In contrast, it is not too effective for the deformed-shape sections 150 to be formed in areas in which the degree of stretching increases during the stretch-flange formation because of fills flowing from surroundings of those areas. Accordingly, it is effective for the deformed-shape sections 150 to be formed in the vicinity of the joined portions 140 and at the stretching regions located in the inner periphery of the tailored blank 110, typically of the thin plates 130, 135.

Consequently, in addition to restrained statuses (restrained statuses of the stepped portions 143 with the respective nests 282) of the joined end faces 142 with the respective restraining mechanisms 280, the stretching of stretching regions 115 is eased during press-forming, enabling the occurrence of cracks or breakings to be further minimized.

That is, as shown in FIG. 12, in addition to the restrained statuses (the restrained statuses of the stepped portions 143 with the respective nests 282) of the joined end faces 142 with the respective restraining mechanisms 280, stress concentrations on the joined portions 140 are minimized, enabling the occurrence of cracks or breakings to be minimized. Additionally, the reduction in the occurrence of cracks or breakings results in improvement over yields of materials and drops in costs.

More particularly, the deformed-shape sections 150 include concave segments 151, respectively, each of which deforms in a direction to stretch the peripheral length. Each concave segment 151 takes the form of a concave region, which has a circular arc shape in cross section and continuously varies from the terminal end in a way to progressively decrease its width and depth and as viewed in a plane, takes the form of a semi-circular cone shape. Therefore, the concave segments 151 have their peripheral lengths stretched during final press-forming without causing any cracks, thereby enabling the stretching regions 115 to be reliably stretched during stretch-flange forming.

Carrying out preliminary press-forming (second press-forming), which is different from final press-forming, allows the deformed-shape sections 150 to be possibly formed. If preliminary press-forming is carried on the plates 220, 225, 230, 235 prior to joining (immediately after blanking) these components, it is feared that deformation occurs in their end faces and probabilities occur in a drop in a welding quality when forming the tailored blank 110 in butt welding. Thus, preliminary press forming may be preferably carried out after welding and prior to final press forming. However, of course, preliminary press forming may be possibly carried out prior to welding.

Figure 14:
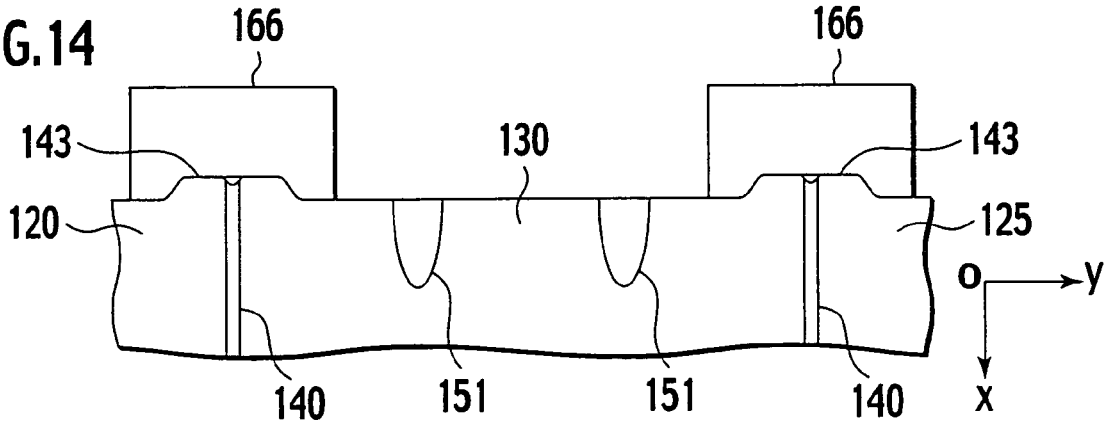
FIG. 14 is an enlarged detail plan view illustrating how the deformed-shape sections are restrained during formation of the deformed-shape sections in the press material of the presently filed embodiment.
Figure 13:
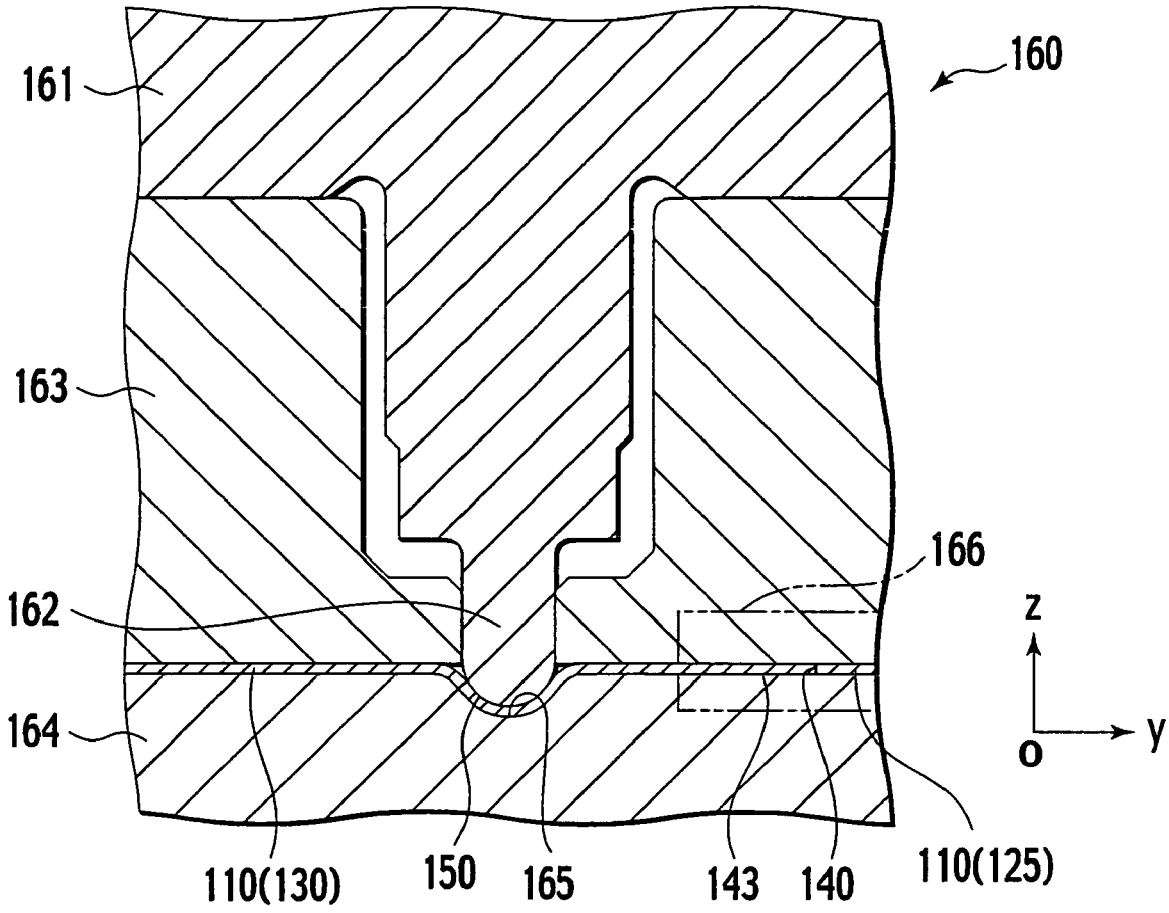
FIG. 13 is an enlarged detail plan view illustrating how the deformed-shape sections in the press material of the presently filed embodiment are formed.

FIG. 13 is a schematic enlarged cross section illustrating how the deformed-shape sections are formed on the press material of the presently filed embodiment, and FIG. 14 is an enlarged detail plan view illustrating the press material of the presently filed embodiment under a restrained condition during forming the deformed-shape sections.

As shown in FIG. 13, a press-forming machine 160 related to preliminary press forming is comprised of a punch (male type member) 161, a holder 163 on which the punch 161 is mounted and held, a die (female type member) 164 and a nest (male type member) 166.

The punch 161 has a protrusion 162 corresponding to a concave shape of the deformed-shape sections 150 of the tailored blank 110 and is placed above the deformed-shape sections 150. The die 164 has a deformed-shape portion forming a concave portion 165 that is substantially in alignment with the concave shape of the deformed-shape sections 150 and is placed beneath the deformed-shape sections 150. The nest 166 is located in an abutting capability to cover the stepped portion 143 that includes the joined portion 140 and its vicinity of the tailored blank 110.

Applying the nests 166, as shown in FIG. 14, enables the stepped portions 143 to be fixedly secured in place. The nests 166 have concave portions, respectively, which correspond to shapes of the stepped portions 143 and are disposed to be moveable closer to or away from the tailored blank 110 to be positioned with respect to the associated joined portions 143. Accordingly, placing the nests 166 in positions to cover the stepped portions 143 (and the joined portions 140 located at the stepped portions 143) in abutting engagement with the tailored blank 110 allows the stepped portions 143 to be reliably fixed.

With such a structure, driving the punch 161, held on the holder 163, causes the protrusion 162 of the punch 161 to compress the area of the tailored blank 110 placed in face-to-face relationship with the deformed-shape sections forming concave portion 165 of the die 164. The compressed area of the tailored blank 110 is caused to deform in a shape in compliance with an inner shape of the deformed-shape sections forming concave portion 165 of the die 164, thereby forming the deformed-shape sections 150.

When this takes place, the nest 166 fixes the stepped portion 143 of the tailored blank 110 in place. As a result, although preliminary press formation causes stress to occur in a direction to create cracks in the joined portion 140 of the tailored blank 110, the occurrence of cracks can be reliably suppressed.

As described above, the press-forming machine 160 is able to form the deformed-shape sections 150 on the tailored blank 110. Incidentally, depending on needs, the press-forming machine 160, related to preliminary press forming, and the press-forming machine P related to final pres forming may be integrally structured.

Further, the deformed-shape sections discussed above are not limited to the concave portions as far as they have shapes that deform in a direction to stretch the peripheral lengths and may be formed in other configurations such as notched portions or stepped portions. In such cases, the other configurations may be sufficed of the types that have shapes with appropriate curvatures operative to reliably eliminate the occurrence of cracks resulting from stress concentration on the notched portions during press forming.

Figure 15:
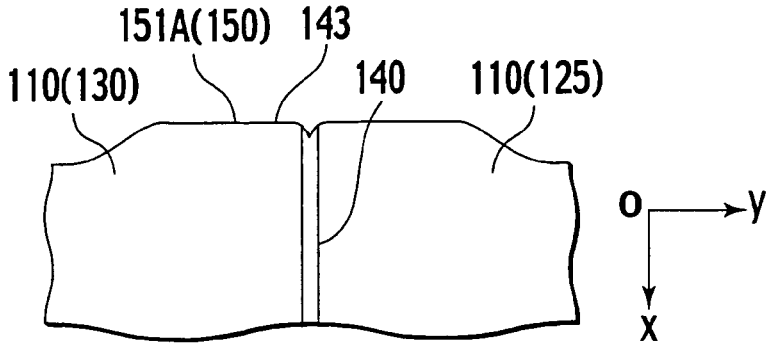
FIG. 15 is an enlarged detail plan view illustrating a modified form of the deformed-shape sections in the press material of the presently filed embodiment.

FIG. 15 is an enlarged detail plan view illustrating a modified form of the deformed-shape sections in the press material of the presently filed embodiment.

As shown in FIG. 15, the deformed-shape sections 150 includes a stepped portion 151A that deforms in a direction to stretch its peripheral length and is formed by extending the stepped portion 143, which is caused to protrude in the vicinity of the joined portion 140 between the different kinds of plates, to extend along an inner periphery of the tailored blank 110.

The stepped portion 151A deforms during final press-forming to stretch its peripheral length, easing to stretch the stretching region during stretch-flange forming. Consequently, stress concentration on the joined portion 140 is minimized during final press-forming, making it possible to minimize the occurrence of cracks or breakings in the joined portion 140.

Extending the vicinity of the joined portion 140 between the different kinds of plates forms the stepped portion 151A. It is, of course, to be appreciated that it is preferable in view of productivity for the stepped portion 151A to be formed concurrent with the blanking operation of the raw material.

Figure 16:
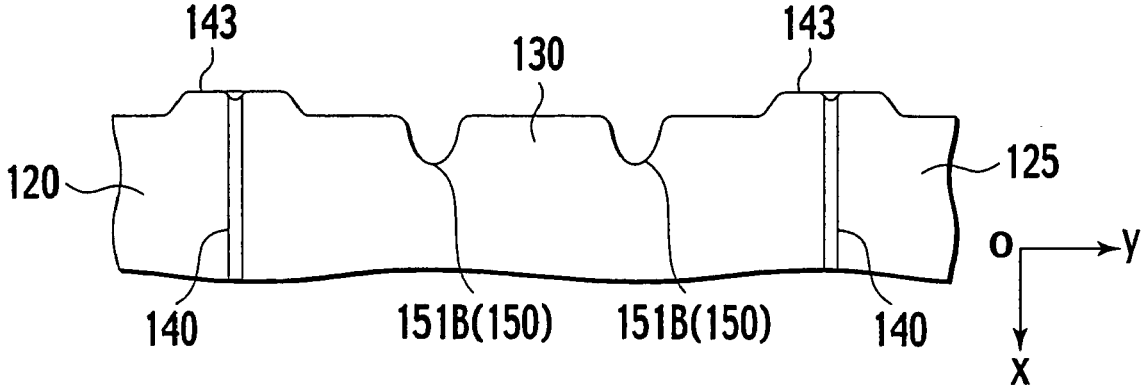
FIG. 16 is an enlarged detail plan view illustrating another modified form of the deformed-shape sections in the press material of the presently filed embodiment.

FIG. 16 is an enlarged detail plan view illustrating another modified form of the deformed-shape sections in the raw material of the presently filed embodiment.

As shown in FIG. 16, the deformed-shape sections 150 include notched portions 151B, respectively, each in a circular arc shape, which deform in a direction to stretch their peripheral lengths.

The notched portions 151B deform during final press forming to stretch its peripheral length, thereby easing up the stretching of the stretching region during stretch-flange forming. Accordingly, stress concentration on the joined portion 140 is minimized during final press forming to make it possible to minimize the occurrence of cracks or breakings in the joined portion 140. It is, of course, to be appreciated that it is preferable in view of productivity for the notched portions 151B to be formed concurrent with the blanking operation of the raw material.

As set forth above, with the presently filed embodiment, the occurrence of deformation in the deformed-shape sections that is preliminarily formed in the vicinity of the joined portion between the different kinds of plates to allow its peripheral length to stretch eases up the stretching of the stretching region during stretch-flange formation.

Consequently, the stress concentration on the joined portion between the different kinds of plates is minimized, enabling the occurrence of cracks or breakings in the joined portion between the different kinds of plates to be minimized. That is, it is possible to provide a press-forming method and a press-forming machine that are able to minimize the occurrence of cracks or breakings in the joined portion located in the stretching region to which stretch-flange formation is carried out.

Further, since such a blank material is formed of the different kinds of plates whose end faces are butt joined, it becomes possible to select an optimum plate thickness or strength for each area, achieving reduction in the number of component parts and lightweight.

Furthermore, the presence of deformation in the deformed-shape sections suppresses the occurrence of cracks or breakings in the joined portion located in the stretching region to which stretch-flange formation is carried out, resulting in improvement over yield of material and reduction in costs.

Accordingly, it becomes possible to provide a press-formed product that is less in the number of component parts, light in weight and low in cost.

Incidentally, such a press-formed product is not limited to a suspension component of an automobile and may be possibly applied to other structural members.

The entire content of a Patent Application No. TOKUGAN 2003-397421 with a filing date of Nov. 27, 2003 in Japan and that of a Patent Application No. TOKUGAN 2004-095367 with a filing date of Mar. 29, 2004 in Japan is hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A method of press forming, comprising:

preparing a plurality of plates;

obtaining a blank from the plurality of plates by butt joining end faces of the plurality of plates to form joined portions, wherein each joined portion is located between one kind of plate and another kind of plate of the plurality of plates, the blank having deformed-shape sections formed only in the one kind of plate in a vicinity of the joined portions so as to allow peripheral lengths of the deformed-shape sections to be stretched, wherein bent portions are formed only in the another kind of plate; and carrying out press-forming, involving stretch-flange formation, on the blank so as to allow the joined portions to be included in stretching regions, respectively, wherein each of the deformed-shape sections has a concave segment that forms a surface varying in a direction perpendicular to a plane of the blank.

2. The method of press forming according to claim 1, wherein the concave segment has a circular arc shape in cross section that progressively decreases in width and depth so as to form a semi-circular cone shape in a plan view.

3. The method of press forming according to claim 1, wherein the deformed-shape sections are formed by carrying out a second press-forming step prior to carrying out the press-forming step that is carried out after the end faces of the plurality of plates have been joined.

4. The method of press forming according to claim 3, wherein prior to joining the end faces of the plurality of plates, stepped portions are formed in regions, involving the end faces of the plurality of plates, so as to extend in a plane of the plurality of plates, wherein the stepped portions are joined when the end faces of the plurality of plates are joined, whereupon the second press-forming is carried out while fixing the stepped portions, which are joined, with a male type member.

5. The method of press forming according to claim 1, wherein the deformed-shape sections are located in the stretching regions to which the stretch-flange formation is carried out.

6. The method of press forming according to claim 1, wherein each of the deformed-shape sections is operative to deform in a direction to stretch a peripheral length during the stretch-flange formation to thereby eliminate stress concentration in a joined portion of the plurality of plates.

7. The method of press forming according to claim 1, wherein the stretch-flange formation is carried out on the blank by restraining ends of the joined portions of the blank.

8. The method of press forming according to claim 7, wherein the stretch-flange formation is carried out on the blank by restraining stepped portions, which extend in a plane from the ends of the joined portions of the blank.

9. The method of press forming according to claim 8, wherein prior to joining the end faces of the plurality of plates, the stepped portions are formed in a region, involving the end faces of the plurality of plates, so as to extend in a plane of the plurality of plates, and the stepped portions are joined when the end faces of the plurality of plates are joined whereupon the stretch-flange formation is carried out while fixing the stepped portions, which are joined, with a male type member.

10. The method of press forming according to claim 8, wherein the stepped portions are removed after the press forming.

11. The method of press forming according to claim 1, wherein the end faces of the plurality of plates are joined by welding.

12. The method of press forming according to claim 11, wherein prior to joining the end faces of the plurality of plates, stepped portions are formed in a region, involving the end faces of the plurality of plates, so as to extend in a plane of the plurality of plates, and the end faces of the plurality of plates are welded while allowing the stepped portions to butt one another and fixing the same with a male type member.

13. The method of press forming according to claim 11, wherein the welding is a plasma welding.

* * * * *

UNITED STATES PATENT AND TRADEMARK OFFICE

CERTIFICATE OF CORRECTION

PATENT NO. : 7,568,272 B2
APPLICATION NO. : 10/988702
DATED : August 4, 2009
INVENTOR(S) : Morita et al.

It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 453 days.

Delete the phrase "by 453 days" and insert -- by 913 days --

Signed and Sealed this

Thirteenth Day of April, 2010

David J. Kappos

David J. Kappos
*Director of the United States Patent and Trademark Office*